US009738504B2

(12) United States Patent
Aranda et al.

(10) Patent No.: US 9,738,504 B2
(45) Date of Patent: Aug. 22, 2017

(54) LOW FORCE ACTUATION DISPENSER PADDLE FOR A DISPENSER ASSEMBLY OF AN APPLIANCE

(71) Applicant: WHIRLPOOL CORPORATION, Benton Harbor, MI (US)

(72) Inventors: Jose R. Aranda, Stevensville, MI (US); Daniel H. Quinlan, Stevensville, MI (US); Todd Tunzi, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 69 days.

(21) Appl. No.: 14/972,820

(22) Filed: Dec. 17, 2015

(65) Prior Publication Data

US 2017/0174493 A1 Jun. 22, 2017

(51) Int. Cl.

| | |
|---|---|
| ***B67D 1/00*** | (2006.01) |
| ***B67D 1/08*** | (2006.01) |
| ***F25D 23/02*** | (2006.01) |
| ***F25D 11/02*** | (2006.01) |
| ***F25D 23/12*** | (2006.01) |
| ***F25C 5/00*** | (2006.01) |

(52) U.S. Cl.

CPC ..... *B67D 1/0014* (2013.01); *B67D 1/0857* (2013.01); *F25C 5/005* (2013.01); *F25D 11/02* (2013.01); *F25D 23/028* (2013.01); *F25D 23/126* (2013.01)

(58) Field of Classification Search

CPC ..... B67D 1/0014; B67D 1/0857; F25C 5/005; F25D 11/02; F25D 23/126; F25D 23/028

USPC ..... 222/144.5, 146.6; 141/362

See application file for complete search history.

(56) References Cited

U.S. PATENT DOCUMENTS

| | | | | |
|---|---|---|---|---|
| 4,679,715 | A * | 7/1987 | Hovinga | B67D 1/00 141/362 |
| 5,442,933 | A | 8/1995 | Unger | |
| 5,474,213 | A | 12/1995 | Unger | |
| 6,135,173 | A | 10/2000 | Lee et al. | |
| 6,267,272 | B1 * | 7/2001 | Shin | F25C 5/005 222/146.5 |
| 6,321,802 | B1 * | 11/2001 | Weeks | F25C 5/007 141/351 |
| 7,340,914 | B2 | 3/2008 | Bowen et al. | |
| 7,418,830 | B2 | 9/2008 | Bowen et al. | |
| 7,814,762 | B2 | 10/2010 | Kavchale et al. | |
| 7,928,331 | B2 | 4/2011 | Lee | |
| 7,980,089 | B2 | 7/2011 | Bowen et al. | |

(Continued)

*Primary Examiner* — Donnell Long

(74) *Attorney, Agent, or Firm* — Price Heneveld LLP

(57) ABSTRACT

A dispensing mechanism for an appliance includes an operable paddle having a lower portion and an upper portion pivotally attached to a dispenser wall between outward and inward positions. An actuator has a switch positioned proximate a pivot defined by a first end of an actuator lever. A second end of the actuator lever is positioned proximate the lower portion of the operable paddle, wherein operation of the operable paddle to the inward position engages the lower portion of the operable paddle with the bottom portion of the actuator lever and operates the actuator lever from an idle state to a use state. Movement of the bottom portion of the actuator lever operates the switch from a deactivated state to an activated state, wherein the activated state of the switch activates the at least one of the ice dispenser and the water dispenser.

20 Claims, 6 Drawing Sheets

(56) References Cited

U.S. PATENT DOCUMENTS

| | | | | |
|---|---|---|---|---|
| 8,069,887 | B2 * | 12/2011 | Dirnberger | F25C 5/007 141/205 |
| 8,333,223 | B2 * | 12/2012 | Seo | F25C 5/005 141/104 |
| 8,348,108 | B2 * | 1/2013 | Choi | F25C 5/005 141/351 |
| D694,295 | S | 11/2013 | Bowen et al. | |
| 8,844,311 | B2 | 9/2014 | Bowen et al. | |
| 2006/0065006 | A1 * | 3/2006 | Park | F25C 5/005 62/344 |
| 2010/0319388 | A1 * | 12/2010 | Yang | F25D 23/126 62/389 |
| 2014/0352347 | A1 | 12/2014 | Bowen et al. | |

* cited by examiner

LOW FORCE ACTUATION DISPENSER PADDLE FOR A DISPENSER ASSEMBLY OF AN APPLIANCE

BACKGROUND

The device is in the field of electrical appliances having dispensing functions. Specifically, the device is in the field of actuating mechanisms for activating and deactivating the dispenser functions of an appliance.

SUMMARY

In at least one aspect, a dispensing mechanism for an appliance includes an operable paddle having a lower portion and an upper portion. The upper portion is pivotally attached to a dispenser wall and is operable between outward and inward positions. The operable paddle is in communication with at least one of an ice dispenser and a water dispenser. An actuator has an actuator lever and a switch positioned proximate a pivot defined by a first end of the actuator lever, wherein a distal portion of the actuator lever proximate a second end of the actuator lever is positioned proximate the lower portion of the operable paddle, wherein operation of the operable paddle to the inward position engages the lower portion of the operable paddle with the distal portion of the actuator lever and operates the actuator lever from an idle state to a use state. Movement of the distal portion of the actuator lever operates the switch from a deactivated state to an activated state, wherein the activated state of the switch activates the at least one of the ice dispenser and the water dispenser.

In at least another aspect, a dispenser activation unit for an appliance includes a first lever having a first end that defines a first fulcrum and a second end that defines an actuating portion, wherein a switch is positioned between the actuating portion and the first fulcrum. The switch is in communication with at least one of an ice dispenser and a water dispenser, wherein the switch is operable between a deactivated state and an activated state that deactivates and activates, respectively, the at least one of the ice dispenser and the water dispenser. A second lever has an upper end that defines a second fulcrum and a lower end that defines an engagement portion, wherein the engagement portion is disposed proximate the actuating portion of the first lever, wherein operation of the second lever from an outward position to an inward position operably engages the first lever to operate from an idle state to a use state, and wherein operation of the first lever from the idle state to the use state operates the switch from the deactivated state to the activated state.

In at least another aspect, a force-reduction unit for activating a dispenser function of an appliance includes a first lever having a first end that defines a first fulcrum and a second end that defines an actuating portion, wherein a switch is positioned between the actuating portion and the first fulcrum. The switch is configured to be in communication with the dispenser function, wherein the switch is operable between a deactivated state and an activated state that deactivates and activates, respectively, the dispenser function. A second lever has an upper end that defines a second fulcrum and a lower end that defines an engagement portion. The engagement portion is disposed proximate the actuating portion of the first lever, wherein operation of the second lever from an outward position to an inward position operably engages the first lever to operate from an idle state to a use state. Operation of the first lever from the idle state to the use state operates the switch from the deactivated state to the activated state.

These and other features, advantages, and objects of the present device will be further understood and appreciated by those skilled in the art upon studying the following specification, claims, and appended drawings.

DETAILED DESCRIPTION OF EMBODIMENTS

Figure 1:
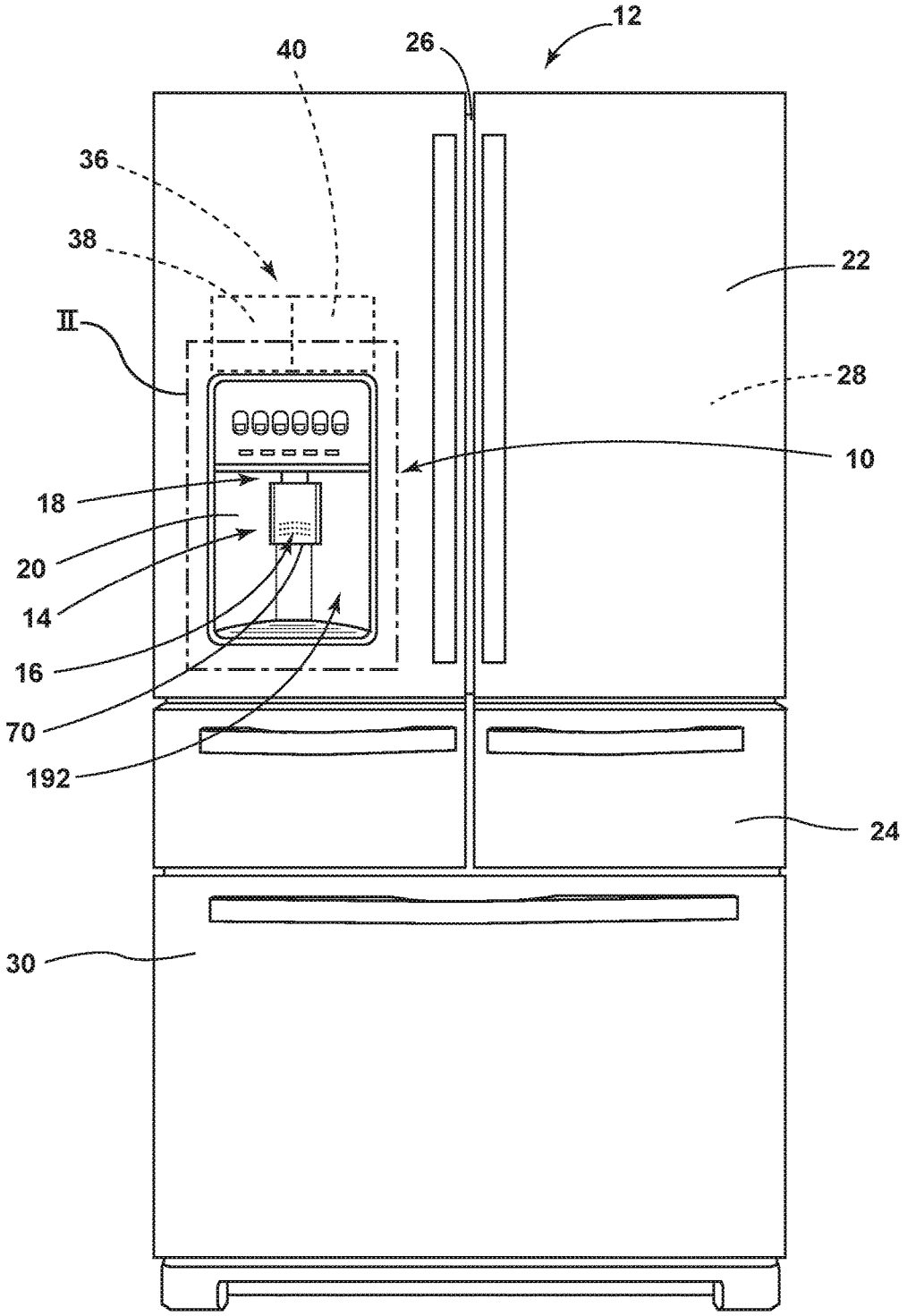
FIG. 1 is a front elevational view of a refrigerating appliance incorporating an aspect of the dispenser activation unit for activating and deactivating a dispenser function for the appliance.
Figure 2:
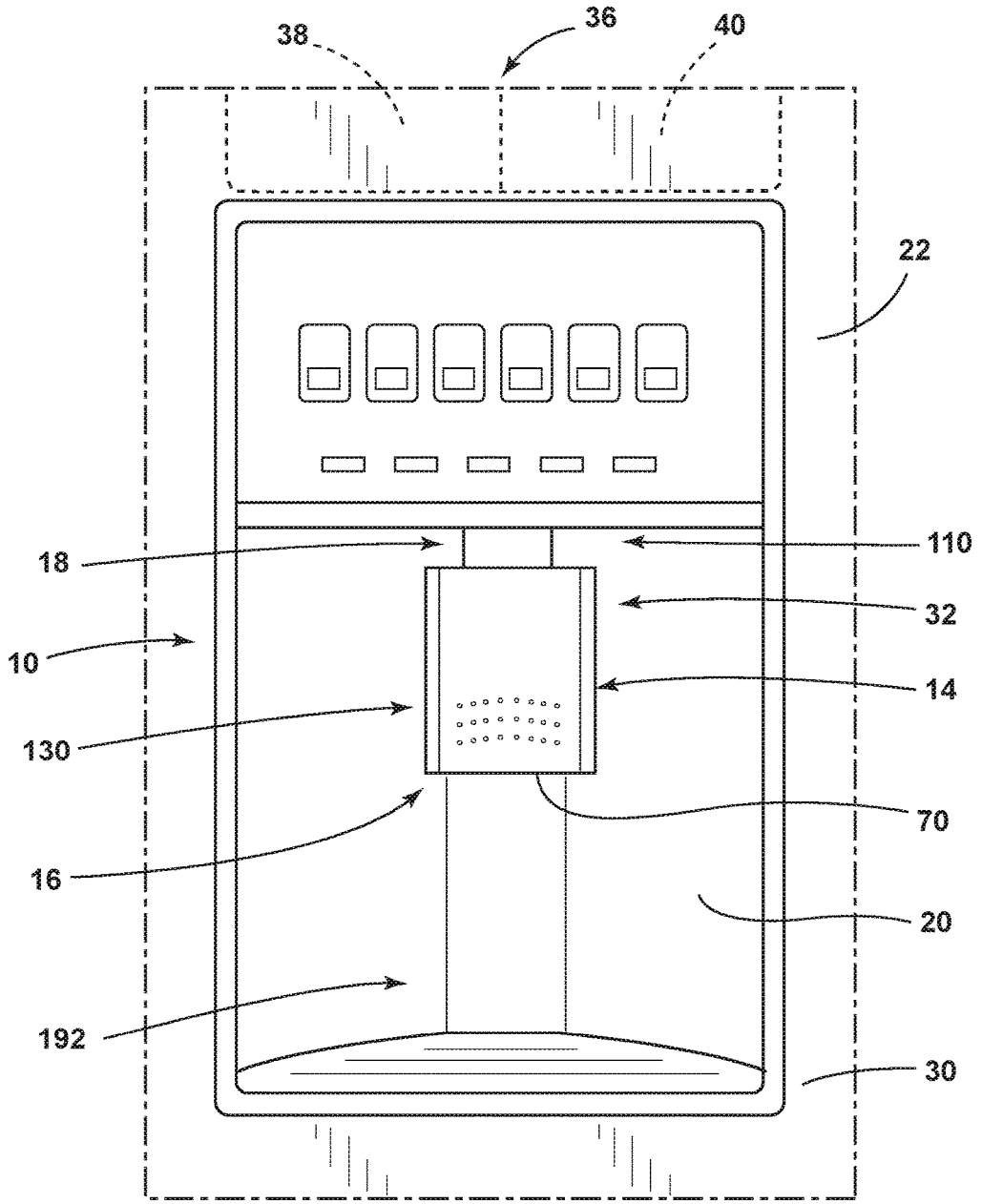
FIG. 2 is an enlarged elevational view of the refrigerating appliance of FIG. 1 taken at area II.
Figure 3:
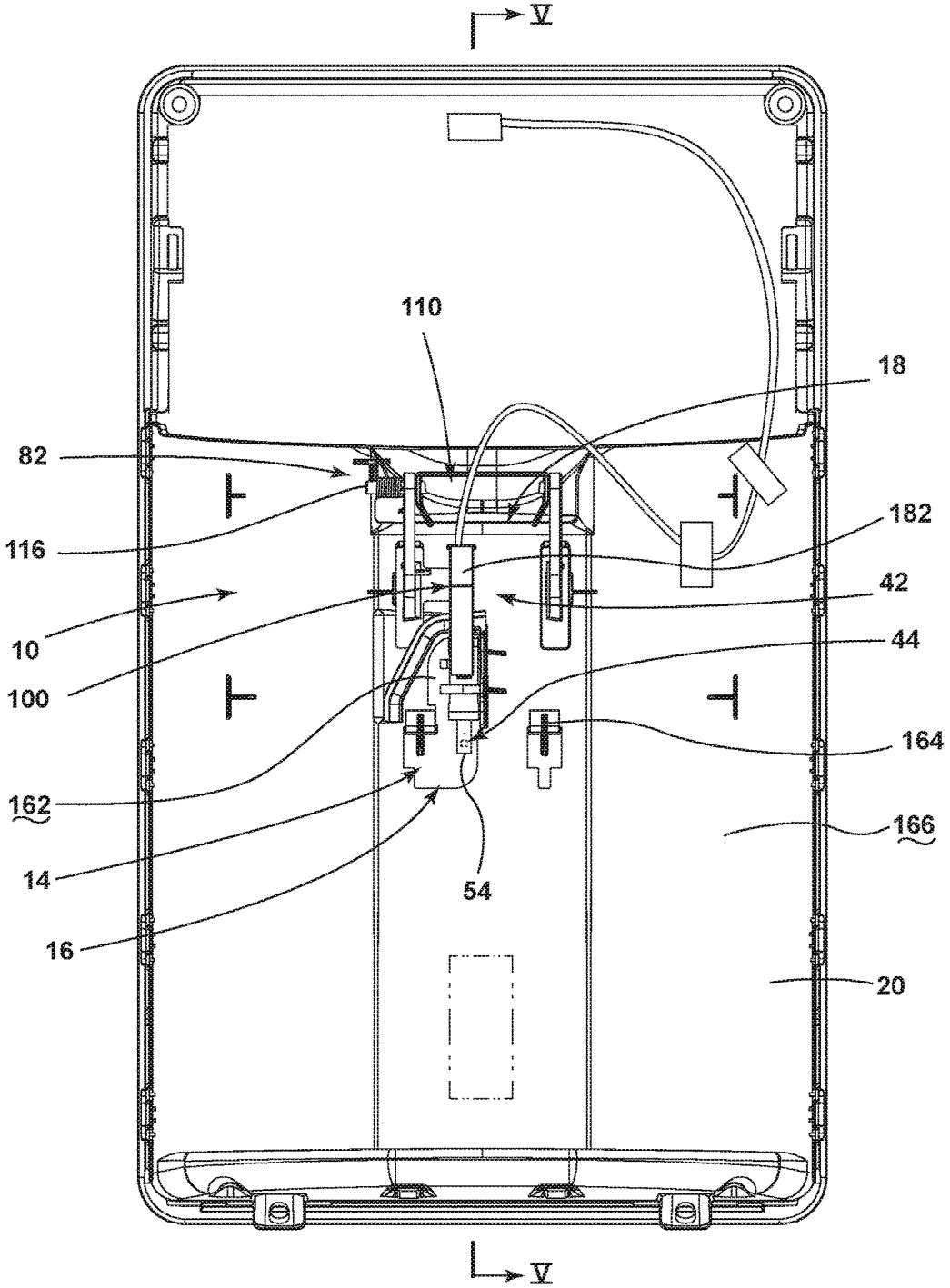
FIG. 3 is a rear elevational view of an aspect of the dispenser assembly for an appliance.
Figure 4:
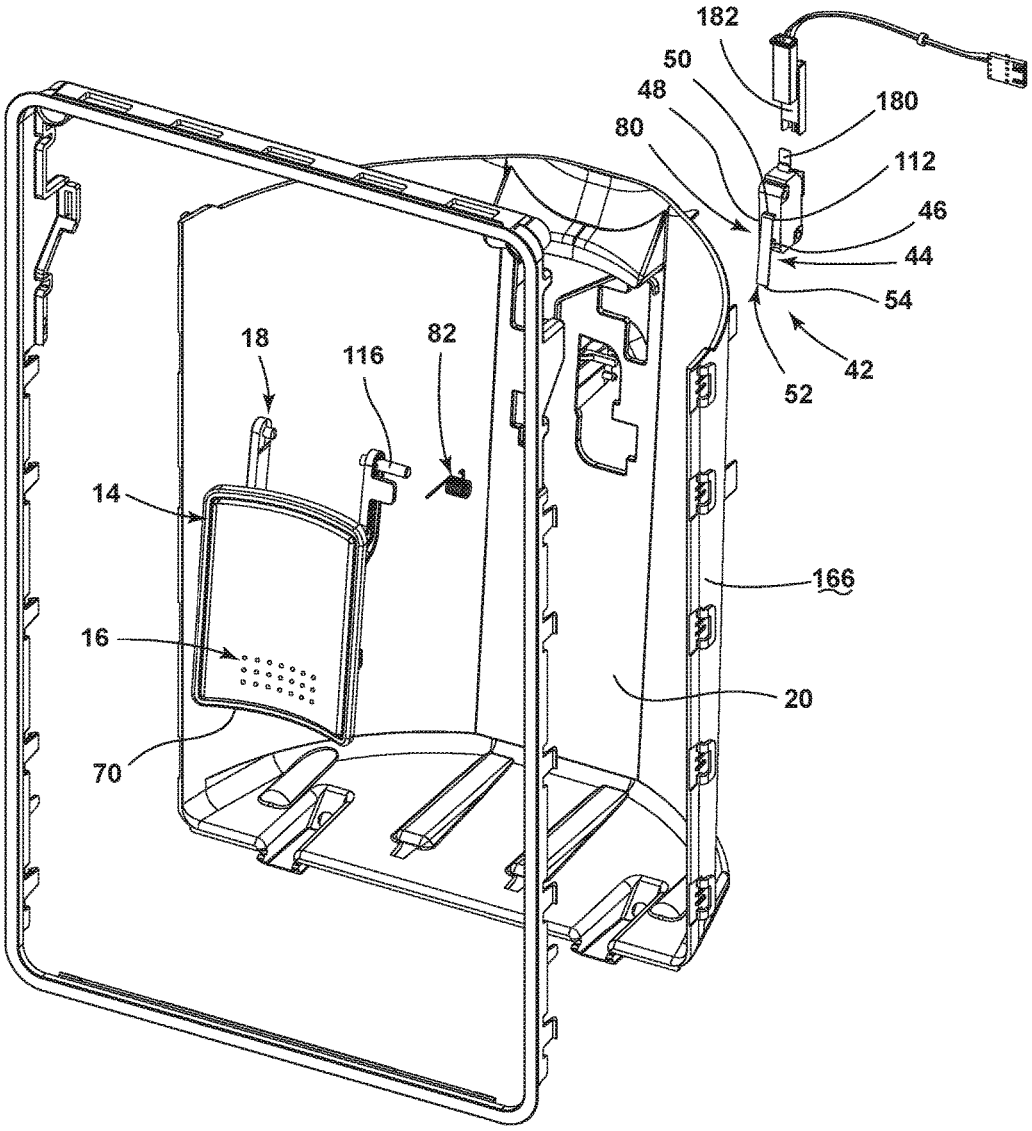
FIG. 4 is an exploded perspective view of the dispenser assembly of FIG. 3.
Figure 5:
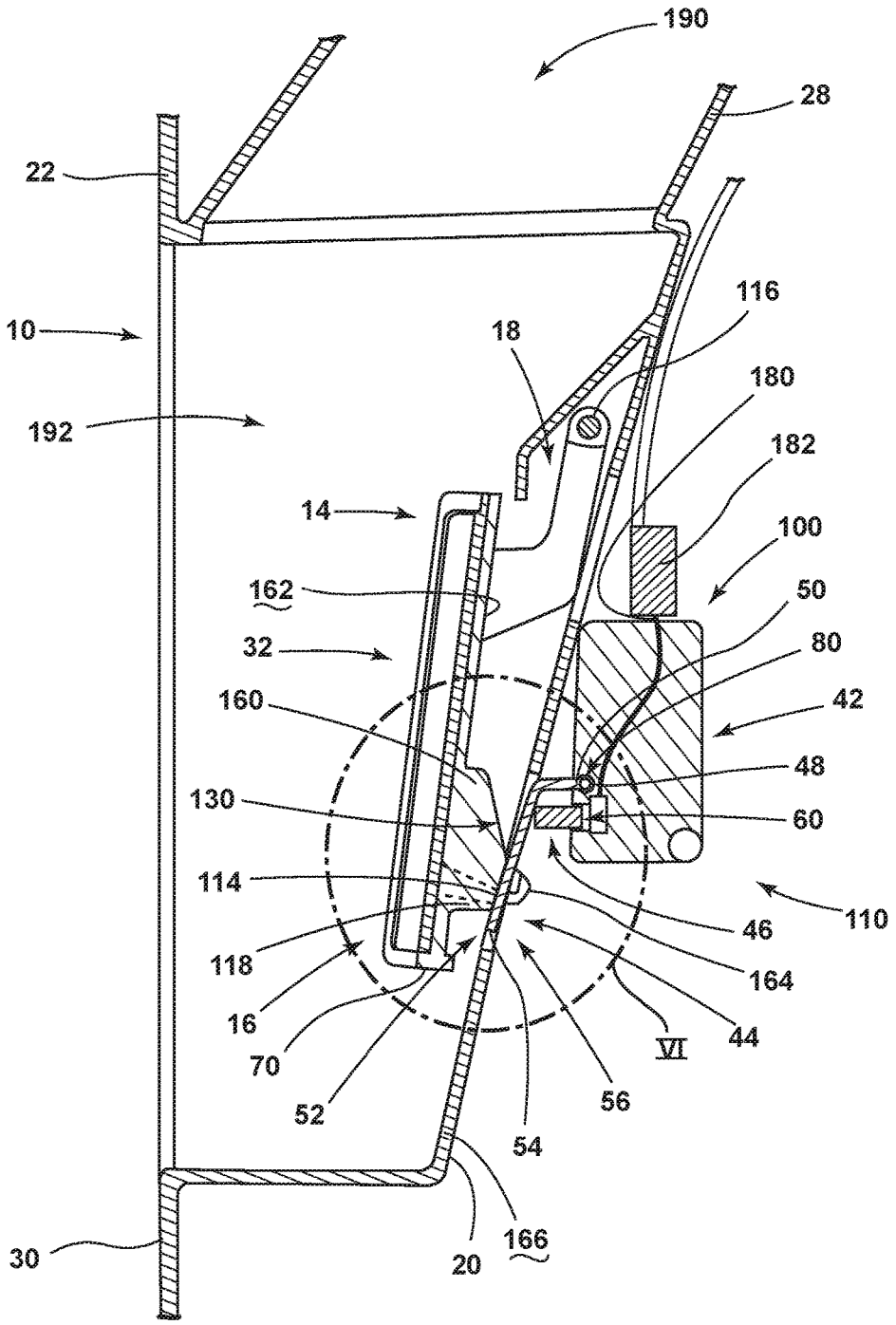
FIG. 5 is a cross-sectional view of a dispenser assembly of FIG. 3 taken along line V-V and showing the operable paddle in an outward position.
Figure 6:
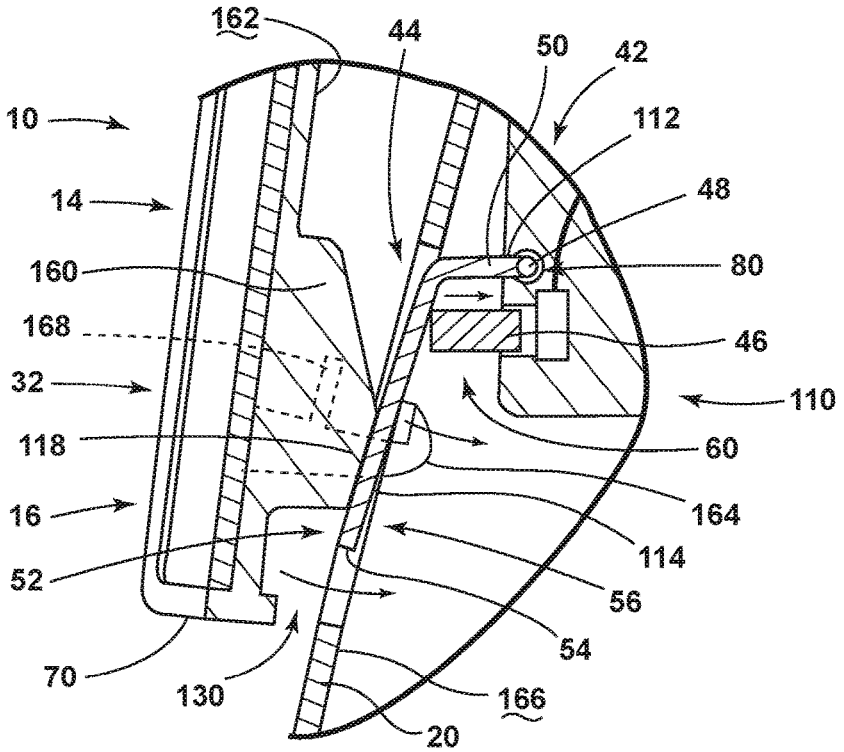
FIG. 6 is an enlarged cross-sectional view of the dispenser assembly of FIG. 5 taken at area VI.
Figure 7:
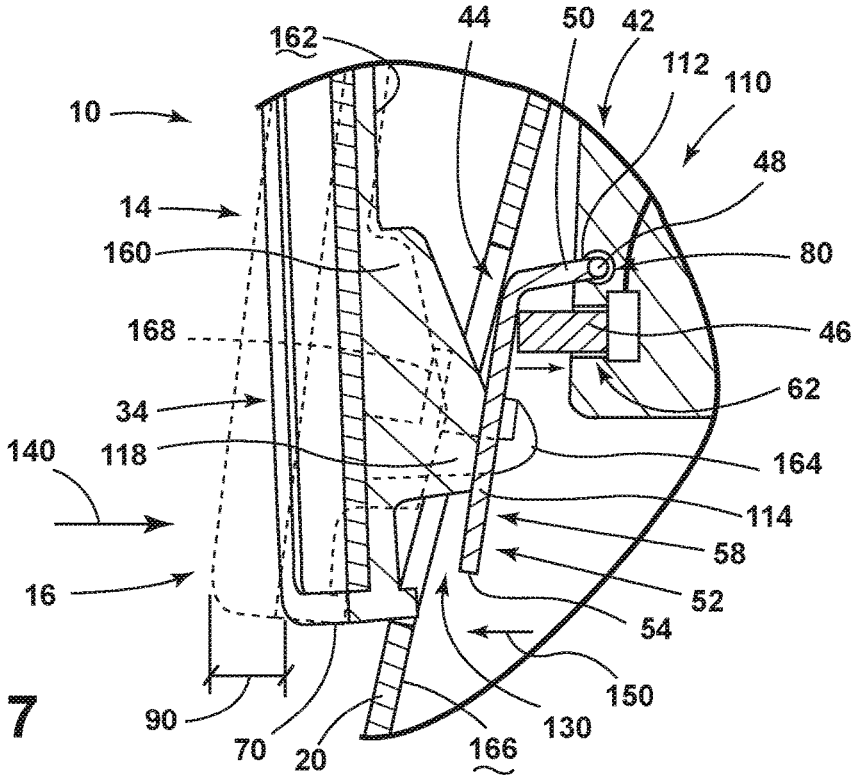
FIG. 7 is an enlarged cross-sectional view of the dispenser assembly of FIG. 6 with the operable paddle moved to the inward position.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

As illustrated in FIGS. 1-7, reference numeral 10 generally refers to a dispensing mechanism that is disposed within an appliance 12. The dispensing mechanism 10 for the appliance 12 includes an operable paddle 14 having a lower portion 16 and an upper portion 18. The upper portion 18 of the operable paddle 14 is pivotally attached to a dispenser wall 20 that is coupled to a structural portion of the appliance 12. Such a structural portion can include a door panel 22, drawer panel 24, cabinet 26, inner liner 28, outer wrapper 30, combinations thereof, or other structural member of the appliance 12. The operable paddle 14 is pivotally operable between outward and inward positions 32, 34. Additionally, the operable paddle 14 is in communication with a dispensing apparatus 36, such as an ice dispenser 38 and/or a water dispenser 40. An actuator 42 includes an actuator lever 44 and a switch 46 positioned proximate a first pivot 48 defined by a first end 50 of the actuator lever 44. A distal portion 52 of the actuator lever 44 proximate the second end 54 of the actuator lever 44 is positioned proximate the lower portion 16 of the operable paddle 14. In this manner, operation of the operable paddle 14 to the inward position 34 serves to engage the lower portion 16 of the operable paddle 14 with the distal portion 52 of the actuator lever 44. In this manner, movement of the operable paddle 14 operates the actuator lever 44 from an idle state 56 to a use state 58. Movement of the distal portion 52 of the actuator lever 44, in turn, operates the switch 46 from a deactivated state 60 to an activated state 62. The activated state 62 of the switch 46 serves to activate at least one dispensing apparatus 36. Conversely, movement of the switch 46 to the deactivated state 60 serves to deactivate the dispensing apparatus 36.

Referring again to FIGS. 1-7, the actuator 42 can include a first biasing mechanism 80 that biases the actuator lever 44 toward the idle state 56. This first biasing mechanism 80 can be attached directly to the switch 46 to bias the switch 46 toward the deactivated state 60. It is also contemplated that the first biasing mechanism 80 can be disposed proximate the first pivot 48 of the actuator lever 44 to bias the actuator lever 44 toward the idle state 56. It is further contemplated that each of the switch 46 and the actuator lever 44 can include separate biasing mechanisms that each bias the switch 46 and the actuator lever 44, respectively, toward the deactivated state 60 and the idle state 56, respectively. It is also contemplated that the operable paddle 14 can include a second biasing mechanism 82 positioned at the upper portion 18 of the operable paddle 14. In such an embodiment, the second biasing mechanism 82 serves to bias the operable paddle 14 toward the outward position 32. Where the dispensing mechanism 10 includes only the first biasing mechanism 80 or both of the first and second biasing mechanisms 80, 82, each of the switch 46, actuator lever 44 and operable paddle 14 are typically biased toward the deactivated state 60, the idle state 56 and the outward position 32, respectively.

Referring again to FIGS. 1-7, it is contemplated that the dispensing mechanism 10 can include only the first biasing mechanism 80 that serves to bias each of the switch 46, the actuator lever 44 and the operable paddle 14 toward the deactivated state 60, the idle state 56 and the outward position 32, respectively. In such an embodiment, it is contemplated that the actuator lever 44 is continually in engagement with both the switch 46 and the operable paddle 14. Such continuous engagement, or substantially continuous engagement, can be defined by a slidable engagement between the actuator lever 44 and the switch 46, as well as between the actuator lever 44 and the operable paddle 14. Various grooves, tabs, sliding mechanisms, and other similar engagement mechanisms can define the close engagement between the switch 46, the actuator lever 44 and the operable paddle 14.

It is contemplated that each aspect of the various embodiments of the dispensing mechanism 10, the switch 46, the actuator lever 44 and the operable paddle 14 define a close engagement, such that minimal movement of the operable paddle 14 toward the inward position 34 causes corresponding movement of the actuator lever 44 toward the use state 58 and further coordinated movement of the switch 46 toward the activated state 62. Conversely, operation of the one or more biasing mechanisms of the dispensing mechanism 10 are adapted to cause similar minimal movement of the switch 46 toward the deactivated state 60, of the actuator lever 44 toward the idle state 56, and of the operable paddle 14 toward the outward position 32. It is contemplated that this close engagement resulting in minimal movement can be defined by a movement of a bottom edge 70 of the operable paddle 14 between the outward position 32 and the inward position 34, an activation distance 90 in the range of from approximately 2 millimeters to approximately 6 millimeters and, typically, approximately 4 millimeters. Movement of this activation distance 90 or range of activation distances 90 serves to place the operable paddle 14 in the inward position 34 and, in turn, move the actuator lever 44 into the use state 58 and the switch 46 into the activated state 62 to activate at least one dispensing apparatus 36 of the appliance 12.

Referring again to FIGS. 3-7, the actuator 42 for the dispensing mechanism 10 can be defined by a limit switch 100 that is disposed behind the operable paddle 14 and attached to the dispenser wall 20. The limit switch 100 can include the actuator lever 44 and the switch 46. It is contemplated that the actuator 42 can be attached directly to the dispenser wall 20, such that the actuator 42 is in a fixed position relative to the dispenser wall 20. In this manner, it is contemplated that the only movable parts of the actuator 42 are the actuator lever 44 and the switch 46. Accordingly, rotational movement within the activation distance 90 of the operable paddle 14 from the outward position 32 to the inward position 34 can be efficiently transferred to operate only the actuator lever 44 and switch 46 without any or substantially any rotational force or movement being transferred to other portions of the appliance 12 that may not serve to activate the dispensing apparatus 36.

Referring again to FIGS. 1-7, it is contemplated that the dispensing mechanism 10 can include a dispenser activation unit 110. This activation unit 110 can include a first lever that corresponds to the actuator lever 44. The actuator lever 44 can include a first end 50 that defines a first fulcrum 112 and a second end 54 that defines an actuating portion 114 of the actuator lever 44. The switch 46 is positioned between the actuating portion 114 and the first fulcrum 112, where the switch 46 is in communication with the ice dispenser 38 and/or the water dispenser 40 of the appliance 12. As discussed above, the switch 46 is operable between the deactivated state 60 and the activated state 62 to deactivate and activate, respectively, at least one of the ice dispenser 38 and water dispenser 40 of the appliance 12. The dispenser activation unit 110 can also include a second lever that corresponds to the operable paddle 14, where the second lever includes the upper portion 18 that defines a second fulcrum 116 and the lower portion 16 that defines an engagement portion 118 of the operable paddle 14. The engagement portion 118 is disposed proximate the actuating portion 114 of the first actuator lever 44. In this manner, operation of the second lever, defined by the operable paddle 14, from the outward position 32 to the inward position 34 operably engages the actuator lever 44 to operate from the idle state 56 to the use state 58. In turn, operation of the actuator lever 44 from the idle state 56 to the use state 58 operates the switch 46 from the deactivated state 60 to the activated state 62. As discussed above, the first biasing mechanism 80, and where present, a second biasing mechanism 82, can serve to cause opposing motion of the switch 46, the actuator lever 44 and the operable paddle 14 to the deactivated state 60, the idle state 56 and the outward position 32, respectively.

Referring again to FIGS. 5-7, the placement of the actuating portion 114 of the actuator lever 44 proximate the engagement portion 118 at the lower end of the operable paddle 14 defines a force reduction unit 130 for activating the dispensing apparatus 36. In this manner, the engagement portion 118 of the operable paddle 14 is disposed between the second fulcrum 116 of the operable paddle 14 and the bottom edge 70 of the operable paddle 14. In this manner, the operable paddle 14, in engaging the actuating portion 114 of the actuator lever 44, defines a class II lever. The load of this lever is defined by the engagement portion 118 overcoming the biasing force of the first biasing mechanism 80 and, where present, the second biasing mechanism 82. This load, typical of a class II lever, is positioned between the second fulcrum 116 and the bottom edge 70. The effort is applied at the bottom edge 70 of the operable paddle 14 by placing a cup or other container against the bottom edge 70 of the operable paddle 14. The use of this type of lever causes a reduction in lateral force 140 against the bottom edge 70 of the operable paddle 14 necessary to move the operable paddle 14 toward the inward position 34 and also to move the actuator lever 44 toward the use state 58. Similarly, the actuator lever 44 defines another class II lever where the load of operating the switch 46 toward the activated state 62 to further overcome at least the first biasing mechanism 80 is positioned between the first fulcrum 112 and the actuating portion 114. The actuating portion 114 of the actuator lever 44 engages the engagement portion 118 of the operable paddle 14. The use of this additional class II lever further reduces the force necessary to operate the switch 46 between the activated state 62 and deactivated state 60. Accordingly, it is contemplated that a lateral force 140 within the range of from approximately 0.2 lbs to 0.6 lbs is utilized to operate the bottom edge 70 of the operable paddle 14 toward the inward position 34 and, in turn, to operate the actuator lever 44 from the idle state 56 to the use state 58, and also to operate the switch 46 from the deactivated state 60 to the activated state 62. Typically, the lateral force 140 necessary to move the bottom edge 70 of the operable paddle 14 from the outward position 32 to the inward position 34 is approximately 0.4 pounds.

According to the various embodiments, the first biasing mechanism 80 disposed proximate at least one of the actuator lever 44 and the switch 46 applies a return force 150 that biases the switch 46 toward the deactivated state 60, the actuator lever 44 back into the idle state 56 and can also, in various embodiments, bias the operable paddle 14 back into the outward position 32. In such an embodiment, the first biasing mechanism 80 is designed to be robust enough to apply enough return force 150 to return the switch 46, the actuator lever 44 and the operable paddle 14 to the deactivated state 60, the idle state 56 and the outward position 32, respectively. It is contemplated that the second biasing mechanism 82 positioned proximate the second pivot of the operable paddle 14 can be attached between the dispenser wall 20 and the operable paddle 14 to assist in applying the return force 150 to bias the operable paddle 14 to the outward position 32.

According to the various embodiments, as exemplified in FIGS. 3-7, it is contemplated that the first biasing mechanism 80 can be a linear spring that is attached to a switch 46 to move the switch 46 in a linear direction from the activated state 62 toward the deactivated state 60. It is also contemplated that the first biasing mechanism 80 can be a torsional spring that is coupled to the first pivot 48 of the actuator lever 44 to bias the actuator lever 44 toward the idle state 56. It is further contemplated that the first biasing mechanism 80 can be a leaf spring such that movement of the actuator lever 44 from between the idle and use states 56, 58 is accomplished through deflection of the material of the actuator lever 44, where the operation of the leaf spring serves to return the actuator lever 44 to its original position defined by the idle state 56.

According to the various embodiments, the first biasing mechanism 80, and where present, the second biasing mechanism 82, can be defined by various linear, torsional, deflection-type and other similar biasing mechanisms that can serve to apply the return force 150 to the switch 46, the actuator lever 44 and the operable paddle 14.

Referring again to FIGS. 3-7, it is contemplated that the operable paddle 14 can include a bumper 160 positioned proximate the rear surface 162 of the operable paddle 14. It is contemplated that this bumper 160 can define the engagement portion 118 of the operable paddle 14 that directly contacts and slidably engages the actuating portion 114 of the actuator lever 44. As discussed above, the engagement between the bumper 160 and the actuating portion 114 of the actuator lever 44 can be a slidable engagement, wherein the bumper 160 is in continual and slidable engagement with the actuating portion 114 of the actuator lever 44. It is also contemplated that the rear surface 162 of the operable paddle 14 can include at least one retention tab 164 that selectively engages the dispenser wall 20 to define the outward position 32 of the operable paddle 14. In such an embodiment, the retention tab 164 of the operable paddle 14 contacts the dispenser wall 20 when the operable paddle 14 is fully biased to the outward position 32. Accordingly, the retention tab 164 substantially prevents further outward movement of the operable paddle 14 beyond the outward position 32. The retention tab 164 engages only the back surface 166 of the dispenser wall 20 such that the operable paddle 14 can be moved toward the inward position 34 and contact between the retention tabs 164 and the back surface 166 of the dispenser wall 20 is removed.

It is also contemplated that the retention tab 164 can include a second retaining feature 168 that further defines a maximum inward position 34 of the operable paddle 14. Accordingly, the various retaining features 168 of the retention tab 164 serve to define a range of movement of the operable paddle 14 between the inward and outward positions 34, 32 such that over rotation is substantially prevented. According to various embodiments, over rotation may result in malfunction of or damage to the dispensing mechanism 10 of the appliance 12.

Referring again to FIGS. 3-7, it is contemplated that the actuator 42 can include at least one contact 180 to which a wiring connector 182 is attached. In this manner, the actuator 42 can be placed in communication with the various dispensing apparatuses 36 of the appliance 12. The various dispensing apparatuses 36 of the appliance 12 can include a crushed ice dispenser 38, a shaved ice dispenser 38, a cubed ice dispenser 38, a chilled water dispenser 40, a water dispenser 40, and other similar material dispensing mechanisms 10.

It is also contemplated that the various aspects of the dispensing mechanism 10 can be in communication with various lighting features, user interface features, and other similar functionalities for the appliance 12. Where the dispensing mechanism 10 is in communication with the dispensing function, the dispensing mechanism 10 can be disposed proximate a dispensing chute 190 extending between the dispensing area 192 of the appliance 12 defined by the dispenser wall 20 and the one or more dispensing apparatuses 36 of the appliance 12. It is contemplated that the operable paddle 14, and the other components of the dispensing mechanism 10 are disposed proximate the dispensing area 192 of the appliance 12 such that when a container, such as a cup, glass, pitcher, or other container, is placed within the dispensing area 192, the operable paddle 14 is moved toward the inward position 34 and the one or more dispensing apparatuses 36 can be activated to dispense a material into the container.

According to the various embodiments, the minimal movement of the activation distance 90 described above of the operable paddle 14 between the outward and inward positions 32, 34 can serve to minimize spillage of the material traveling through the dispensing chute 190. In this manner, minimal movement of the container during activation of the dispensing apparatus 36 serves to maintain the container close to a single position proximate the dispensing chute 190. As discussed above, the minimal movement of the operable paddle 14 within the activation distance 90 and within the dispensing area 192 of the appliance 12 serves to maintain the container in a position near the dispensing chute 190 such that spillage of material dispensed from the dispensing chute 190 can be minimized through a substantially consistent placement of the container within the dispensing area 192 when the operable paddle 14 is moved from the outward position 32 to the inward position 34 to operate the actuator lever 44 and switch 46. Additionally, the minimal lateral force 140 needed to move the operable paddle 14 the activation distance 90 also serves to limit spillage as only minimal lateral force 140 within the activation distance 90 is necessary to activate the dispensing apparatus 36.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A dispensing mechanism for an appliance, the dispensing mechanism comprising:

an operable paddle having a lower portion and an upper portion, the upper portion pivotally attached to a dispenser wall and operable between outward and inward positions, wherein the operable paddle is in communication with at least one of an ice dispenser and a water dispenser; and an actuator having an actuator lever and a switch positioned proximate a pivot defined by a first end of the actuator lever, wherein a distal portion of the actuator lever proximate a second end of the actuator lever is positioned proximate the lower portion of the operable paddle, wherein operation of the operable paddle to the inward position engages the lower portion of the operable paddle with the distal portion of the actuator lever and operates the actuator lever from an idle state to a use state, and wherein movement of the distal portion of the actuator lever operates the switch from a deactivated state to an activated state, wherein the activated state of the switch activates the at least one of the ice dispenser and the water dispenser.

2. The dispensing mechanism of claim 1, wherein a bottom edge of the operable paddle moves from the outward position toward the inward position a distance of approximately 4 millimeters to place the actuator lever in the use state and the switch in the activated state.

3. The dispensing mechanism of claim 1, wherein the operable paddle is engaged with the actuator lever in the outward and inward positions.

4. The dispensing mechanism of claim 3, wherein the operable paddle is slidably engaged with the actuator lever and the actuator lever is slidably engaged with the switch.

5. The dispensing mechanism of claim 1, wherein the actuator includes a first biasing mechanism that biases the actuator lever toward the idle state.

6. The dispensing mechanism of claim 5, wherein the first biasing mechanism is attached to the switch to bias the switch toward the deactivated state.

7. The dispensing mechanism of claim 6, wherein the operable paddle includes a second biasing mechanism at the upper portion of the operable paddle, wherein the second biasing mechanism biases the operable paddle toward the outward position.

8. The dispensing mechanism of claim 5, wherein a lateral force of approximately 0.4 pounds applied to a bottom edge of the operable paddle toward the inward position operates the operable paddle to define the inward position.

9. A dispenser activation unit for an appliance, the dispenser activation unit comprising:

a first lever having a first end that defines a first fulcrum and a second end that defines an actuating portion, wherein a switch is positioned between the actuating portion and the first fulcrum, the switch being in communication with at least one of an ice dispenser and a water dispenser, wherein the switch is operable between a deactivated state and an activated state that deactivates and activates, respectively, the at least one of the ice dispenser and the water dispenser; and a second lever having an upper end that defines a second fulcrum and a lower end that defines an engagement portion, wherein the engagement portion is disposed proximate the actuating portion of the first lever, wherein operation of the second lever from an outward position to an inward position operably engages the first lever to operate from an idle state to a use state, and wherein operation of the first lever from the idle state to the use state operates the switch from the deactivated state to the activated state.

10. The dispenser activation unit of claim 9, wherein a first biasing mechanism is positioned proximate the first lever and biases the first lever toward the idle state.

11. The dispenser activation unit of claim 10, wherein the first biasing mechanism is attached to the switch and biases the switch to the deactivated state.

12. The dispenser activation unit of claim 11, wherein the first biasing mechanism biases the switch to the deactivated state, biases the first lever to the idle state and biases the second lever to the outward position.

13. The dispenser activation unit of claim 12, wherein the engagement portion of the second lever is slidably engaged with the actuating portion of the first lever.

14. The dispenser activation unit of claim 10, wherein the second lever includes a second biasing mechanism positioned at the second fulcrum that biases the second lever toward the outward position, wherein the second lever is pivotally coupled to a dispenser wall at the second fulcrum.

15. The dispenser activation unit of claim 9, wherein a bottom edge of the second lever moves from the outward position toward the inward position a distance of approximately 4 millimeters to place the first lever in the use state and the switch in the activated state.

16. The dispenser activation unit of claim 9, wherein a lateral force of approximately 0.4 pounds applied to a bottom edge of the second lever toward the inward position operates the second lever to define the inward position.

17. A force-reduction unit for activating a dispenser function of an appliance, the force-reduction unit comprising:

a first lever having a first end that defines a first fulcrum and a second end that defines an actuating portion, wherein a switch is positioned between the actuating portion and the first fulcrum, the switch configured to be in communication with the dispenser function, wherein the switch is operable between a deactivated state and an activated state that deactivates and activates, respectively, the dispenser function; and a second lever having an upper end that defines a second fulcrum and a lower end that defines an engagement portion, wherein the engagement portion is disposed proximate the actuating portion of the first lever, wherein operation of the second lever from an outward position to an inward position operably engages the first lever to operate from an idle state to a use state, and wherein operation of the first lever from the idle state to the use state operates the switch from the deactivated state to the activated state.

18. The force-reduction unit of claim 17, wherein a first biasing mechanism is positioned proximate the first lever and biases the first lever toward the idle state.

19. The force-reduction unit of claim 17, wherein a bottom edge of the second lever moves from the outward position toward the inward position a distance of approximately 4 millimeters to place the first lever in the use state and the switch in the activated state.

20. The force-reduction unit of claim 17, wherein a lateral force of approximately 0.4 pounds applied to a bottom edge of the second lever toward the inward position operates the second lever to define the inward position.

* * * * *